US007758062B2

(12) United States Patent
Klubitschko

(10) Patent No.: US 7,758,062 B2
(45) Date of Patent: Jul. 20, 2010

(54) BOOT RETAINING UNIT OF A SKI BINDING

(75) Inventor: Gerd Klubitschko, Oberammergau (DE)

(73) Assignee: MARKER Deutschland GmbH, Penzberg (DE)

( * ) Notice: Subject to any disclaimer, the term of this patent is extended or adjusted under 35 U.S.C. 154(b) by 203 days.

(21) Appl. No.: 11/841,133

(22) Filed: Aug. 20, 2007

(65) Prior Publication Data

US 2008/0048430 A1 Feb. 28, 2008

(30) Foreign Application Priority Data

Aug. 25, 2006 (DE) ..... 10 2006 039 989

(51) Int. Cl.
*A63C 9/08* (2006.01)

(52) U.S. Cl. ..... 280/613; 280/614; 280/615; 280/624; 280/626

(58) Field of Classification Search ..... 280/611, 280/613, 614, 615, 623, 624, 626, 627, 628
See application file for complete search history.

(56) References Cited

U.S. PATENT DOCUMENTS

| | | | | | |
|---|---|---|---|---|---|
| 3,603,607 | A | * | 9/1971 | Marker et al. | 280/625 |
| 3,900,207 | A | * | 8/1975 | Iizuka | 280/625 |
| 4,682,786 | A | * | 7/1987 | Peyre | 280/628 |
| 5,020,823 | A | * | 6/1991 | Bogner | 280/634 |
| 5,121,939 | A | * | 6/1992 | Peyre | 280/634 |
| 5,328,201 | A | * | 7/1994 | Wladar | 280/625 |
| 5,997,026 | A | * | 12/1999 | Klubitschko et al. | 280/607 |
| 6,588,791 | B1 | * | 7/2003 | Horn | 280/613 |

FOREIGN PATENT DOCUMENTS

| | | | |
|---|---|---|---|
| AT | 352598 | A | 2/1979 |
| CH | 0686707 | A5 | 6/1996 |
| DE | 1963149 | * | 6/1971 |
| DE | 1963149 | A1 | 6/1971 |
| DE | 1578702 | A1 | 8/1971 |
| DE | 2034355 | A1 | 1/1972 |
| DE | 2359352 | A1 | 8/1974 |
| DE | 2513456 | A1 | 12/1975 |
| DE | 2513456 | A1 | 12/1975 |
| EP | 0626875 | B1 | 12/1995 |
| EP | 0754079 | B1 | 1/1997 |

OTHER PUBLICATIONS

European Patent Search Report dated Dec. 3, 2008, Application No. 07113589.1; 7 pages.

* cited by examiner

*Primary Examiner*—Glenn Dayoan
*Assistant Examiner*—Erez Gurari
(74) *Attorney, Agent, or Firm*—Wildman, Harrold, Allen & Dixon LLP

(57) ABSTRACT

A boot-retaining unit of a ski binding secures one end, in particular the toe end, of a ski boot using two boot sole holders pivotable about vertical axes, which engage an end region of the sole periphery or ski boot from the side, front and/or top and interact with a spring arrangement, which biases the boot/sole holder against the boot/sole periphery and allows the ski boot to be disengaged counter to a disengaging resistance. The sole holders are double-armed levers, with the lever arms of the sole holders distal from the sole interacting with pistons which are displaceable in a direction transverse to the ski binding's axis and, by a spring which is clamped between and engages the pistons, are forced against the lever arms which are remote from the sole.

7 Claims, 2 Drawing Sheets

BOOT RETAINING UNIT OF A SKI BINDING

FIELD OF INVENTION

This invention relates generally to snow skiing equipment, and is particularly directed to a ski binding for use in downhill and cross-country skiing.

BACKGROUND OF THE INVENTION

The invention relates to a boot-retaining unit of a ski binding for securing one end, in particular the toe end, of a ski boot by way of two boot or sole holders which can be pivoted about vertical axes, engage around an end region of the sole periphery or of the ski boot from the side, front and/or top and interact with a spring arrangement, which biases the boot or sole holder against the boot or sole periphery and allows the ski boot to be disengaged counter to a disengaging resistance.

Such boot-retaining units are known in general. In the case of such a boot-retaining unit which is known from DE 25 13 456 A1, the sole holders are forcibly coupled to tooth segments which are arranged on them and mesh with one another, in which case they always assume similar positions. One of the sole holders is designed as a double-armed lever with a sole-side lever arm, which serves for securing the sole, and a lever arm which is remote from the sole and interacts with the spring unit, which is designed as a compression spring.

In the case of the boot-retaining unit which is known from DE 20 34 355 A1, the sole holders are designed as single-armed levers which, by means of a tension spring arranged between them, are biased into their normal position, in which the ski-boot sole is clamped in.

EP 0 626 875 B1 also discloses a boot-retaining unit with single-armed sole holders. Each sole holder is supported on an associated guide surface by means of a roller, the guide surface being arranged in each case on a double-armed lever, of which the arm which is remote from the guide surface interacts with the spring unit. It is thus possible for the guide surface, when subjected to sufficiently high loading by the roller, to yield counter to spring force, in which case the sole holders release the ski boot.

DE-A 1 578 702 discloses a boot-retaining unit with a single sole holder which engages around the toe of the boot in a C-shaped manner. This sole holder is guided such that it can be displaced transversely counter to spring force, the ski boot coming free when the sole holder is displaced sideways to a sufficient extent.

A similar boot-retaining unit is described in CH 686 707 A5. In this case, however, the sole holder, which engages around the toe of the boot in a C-shaped manner, is arranged such that it can be pivoted about a vertical axis and is coupled to a spring unit which is arranged beneath a boot-bearing surface and biases the sole holder into its normal position, in which the toe of the boot is secured.

EP 0 754 079 A1 also discloses a boot-retaining unit with a single sole holder which engages around the toe of the boot in a C-shaped manner, can be pivoted about a vertical axis and interacts with a spring arrangement provided beneath the boot-bearing surface.

The boot-retaining units of ski bindings are, generally, comparatively voluminous. This is not usually critical when the housings of the boot-retaining units are arranged in a stationary manner on the top side of the ski, as is typically the case for downhill skis. For cross-country skis, however, provision is usually made for the ski boot to be secured on a bearing plate which can be pivoted upward relative to the top side of the ski about a transverse axis on the toe region of the ski boot, in which case the heel can be lifted off from the ski for cross-country skiing purposes. There is only a comparatively small amount of space available in this case for boot-retaining units for securing the toe of the boot. Accordingly, cross-country ski bindings in which the toe of the boot is secured in sole holders which are stationary in relation to the bearing plate, and only disengagement of the heel of the boot is possible, are available on the market. This is synonymous with the boot-retaining unit which is arranged on the heel having to make it possible for the boot to be disengaged sideways in the event of a fall. Otherwise, it would not be possible for the boot to be detached from the ski in the event of a fall with turning action. Nevertheless, such a binding offers a reduced, albeit usually sufficient, level of safety in the event of the skier falling.

OBJECTS AND SUMMARY OF THE INVENTION

The object of the invention, then, is to provide a boot-retaining unit which is suitable for securing the toe of the boot and is distinguished by a low volume and reliable disengaging behavior.

This object is achieved, in the case of a boot-retaining unit of the type specified in the introduction, in that the boot or sole holders are designed as double-armed levers, those lever arms which are remote from the sole interacting with pistons which are guided in a displaceable manner in the direction of the transverse axis of the ski binding and, by means of a compression spring which is common to both pistons and is clamped in between the pistons, are forced against the lever arms which are remote from the sole. The invention provides the advantage of it being possible to use a single spring arrangement for both boot or sole holders, although each boot or sole holder remains removable on an individual basis for release or disengagement of the ski boot.

According to an embodiment of preferred design, the two pistons may be guided in a displaceable manner in a cylinder which is common to both pistons and has the cylinder axis parallel to the transverse axis of the boot-retaining unit. It is possible here for the cylinder, together with the two pistons, to form a pneumatic impact damper which counteracts premature disengagement in the event of the ski boot being subjected to impact. If one of the sole holders is pivoted in order to disengage the ski boot, the associated piston is inevitably pushed into the cylinder, in which case the air contained in the cylinder by the pistons is compressed, with the disengaging resistance of the sole holder being increased in the process. As a result of a lack of sealing, predetermined by the design, between the pistons and the cylinder wall which guides the same, and/or by way of a throttle valve, it is possible here for air to be displaced out of the cylinder into the atmosphere, the throttle resistance which counteracts the displaced air acting with the effect of damping the displacement movement of the piston and thus the disengaging movement of the boot or sole holder. This damping resistance is all the more pronounced the quicker the one piston or the other is displaced or the quicker the one of the boot or sole holders is moved in the disengaging direction. Upon very slow (quasi static) movement of the piston or sole holder, the air is channeled out of the cylinder into the atmosphere without it being possible for any significant flow resistance to become established. In the event of "slow" falling, for example from the skier's standing position, the disengaging resistance is thus predetermined virtually exclusively by the strength of the spring unit, whereas, during rapid travel and in the event of dynamic impacts, the disengaging resistance is determined in addition by the throttle resistance which counteracts the air escaping from the cylinder.

The cylinder may readily be arranged on the toe-side transverse periphery of a bearing plate for the ski boot, in which case it is also readily possible for the boot-retaining unit according to the invention to be used for cross-country ski bindings with a bearing plate which can be pivoted upward at the heel.

According to a further preferred embodiment of the invention, a guideway which interacts with that end of the boot or sole holder which is remote from the boot may be arranged on that end side of each piston which is directed toward the sole holder, in which case the disengaging behavior of the sole holder can be predetermined virtually as desired.

In addition, in respect of preferred features of the invention, reference is made to the claims and the following explanation of the drawing, with reference to which a particularly preferred embodiment of the invention will be described in more detail.

Protection is claimed not just for specifically illustrated combinations of features, but also for basically any desired combinations of the features illustrated.

DETAILED DESCRIPTION OF PREFERRED EMBODIMENTS

Figure 1:
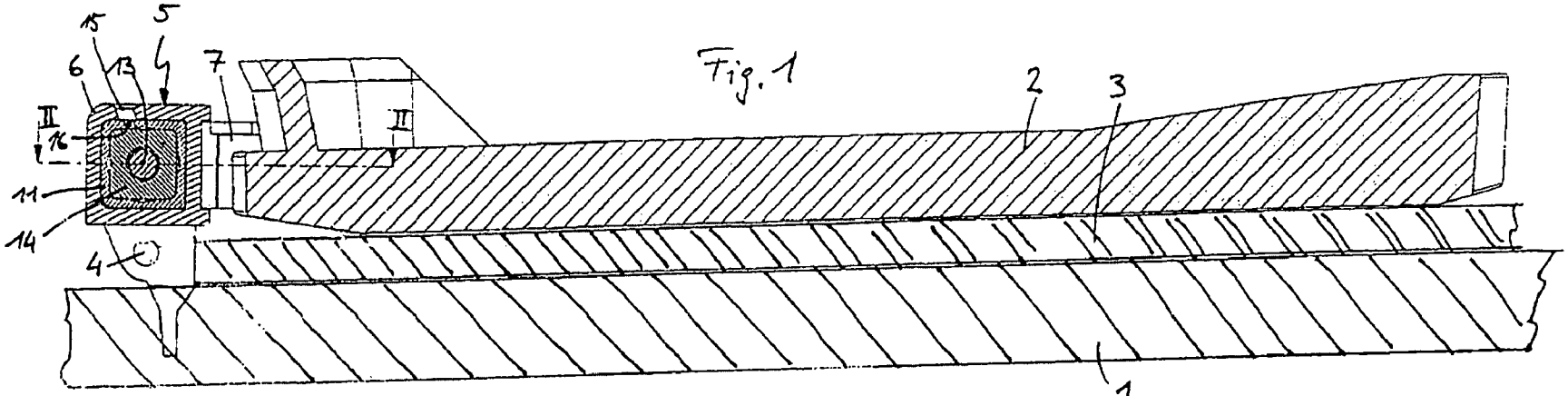
FIG. 1 shows a vertical longitudinal section of the boot-retaining unit according to the invention, corresponding to section line I-I in FIG. 2, and of a ski-boot sole which interacts therewith.

In the example of FIG. 1, a bearing plate 3 is provided on a ski 1 in order to accommodate a ski boot, of which only the sole 2 is illustrated in FIG. 1, it being possible for the bearing plate to be pivoted upward relative to the ski about a front transverse axis 4. A front boot-retaining unit 5 and a rear boot-retaining unit (not illustrated) are arranged on the bearing plate 3 and secure the sole 2 of the ski boot in a disengageable manner on the bearing plate 3.

In contrast to the embodiment illustrated in the drawing, it should also be possible for the front boot-retaining unit 5 and the rear boot-retaining unit (not illustrated) to be arranged directly on the top side of the ski, in order for the ski boot or its sole 2 to be fixed in a disengageable manner directly on the ski 1.

The bearing plate 3 can be secured in an immovable manner on the top side of the ski, by way of arresting means (not illustrated), when the ski is used for downhill skiing. The capability of the bearing plate 3 to pivot in relation to the transverse axis 4 is utilized predominantly only for cross-country skiing.

The boot-retaining unit 5 has a cylindrical housing 6 which extends in the transverse direction, parallel to the transverse axis 4, and has a non-round, essentially square cross section. Sole holders 7 and 8 are arranged at the open ends of the cylindrical housing 6 such that they can be pivoted about vertical axes 9. The sole holders 7 and 8 are formed such that in the use position, which is illustrated in FIG. 2, they engage around front corner regions of the sole 2 from the front and the side and engage over the same from above.

The sole holders 7 and 8 are each designed as double-armed levers, the respective lever arm which is remote from the sole interacting with a guide-like end side of a piston 10 or 11, respectively, which has a cross section adapted to the square cross section of the cylindrical housing 6 and is guided in a displaceable manner in the housing 6. Within the housing 6, a helical compression spring 12 (only illustrated schematically) is clamped in between the pistons 10 and 11 and biases the pistons 10 and 11 against the sole holders 7 and 8, this causing the latter to seek the use position of FIG. 2. Since the vertical axes 9 are located within the piston cross section, as seen in an axial view of the pistons 10 and 11, and the sole holders 7 and 8 interact in a stop-like manner with housing peripheries 6' and 6", the sole holders 7 and 8 also act as end stops for the pistons 10 and 11 when there has been no boot, or no boot sole 2, inserted into the boot-retaining unit 5. In the latter case, too, those positions of the sole holders 7 and 8 which are illustrated in FIG. 2 constitute end positions.

Figure 2:
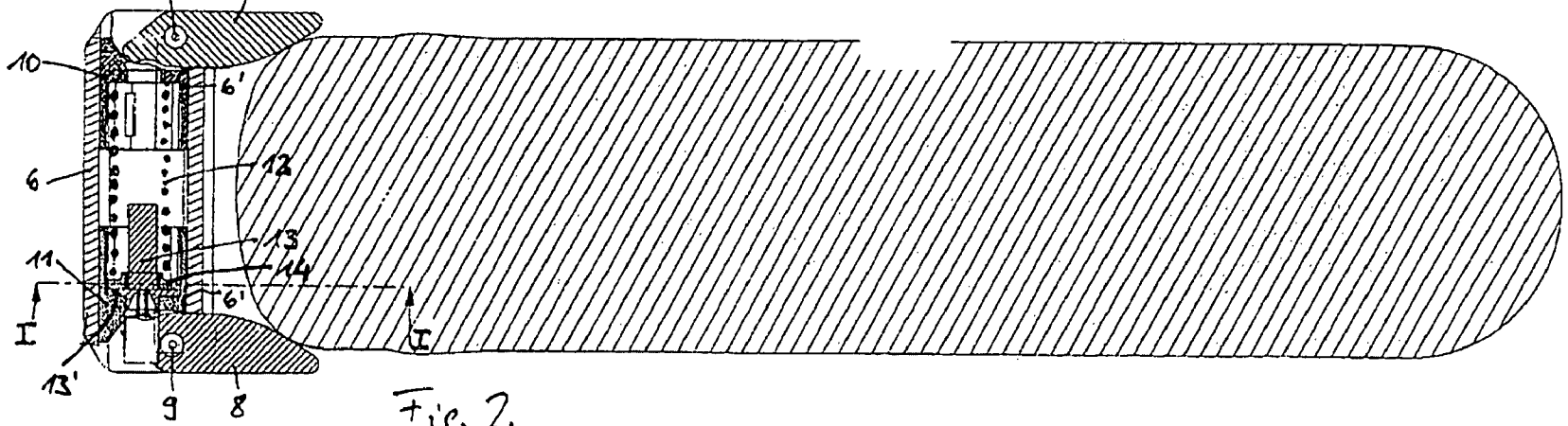
FIG. 2 shows a horizontal section corresponding to section line II-II in FIG. 1.

The piston 11, which is at the bottom in FIG. 2, contains an adjusting screw 13 which is mounted axially, by way of a circular disk 13' integrally formed on it, on the facing side of the head of the piston 11. Arranged on the threaded part of the adjusting screw 13, such that it can be adjusted by screwing action, is a nut 14 which is shaped in adaptation to the square cross section of the piston 11 and is thus secured within the piston 11 such that it cannot be rotated. Rotary adjustment of the adjusting screw 13, which passes through a bore in the head of the piston 11 by way of a head which contains a recess provided for the form-fitting engagement of a screwing tool, allows the nut 14 to be adjusted axially within the piston 11. The stressing of the helical compression spring 12, of which one abutment is formed by the head of the piston 10 and the other abutment is formed by the nut 14, is thus changed correspondingly, this also resulting in a change in the disengaging resistance, counter to which the sole holders 7 and 8 can pivot out of their use position according to FIG. 2 into a release position according to FIG. 3 if the sole 2 is subjected to corresponding sideways forces. The position of the nut 14 within the piston 11, and thus the level of stressing set for the helical compression spring 12, can be seen through slot-like windows 15 and 16 which extend parallel to the transverse axis 4 and are arranged to coincide with one another within the wall of the housing 6 and of the piston 11. The window 15 of the housing 6 may possibly be provided with a scale, from which it is possible to read, from the position of the nut 14 and the disengaging resistance set (so-called Z value), if the sole holders 7 and 8, and thus the pistons 10 and 11, are located in the end positions of FIG. 2.

Figure 3:
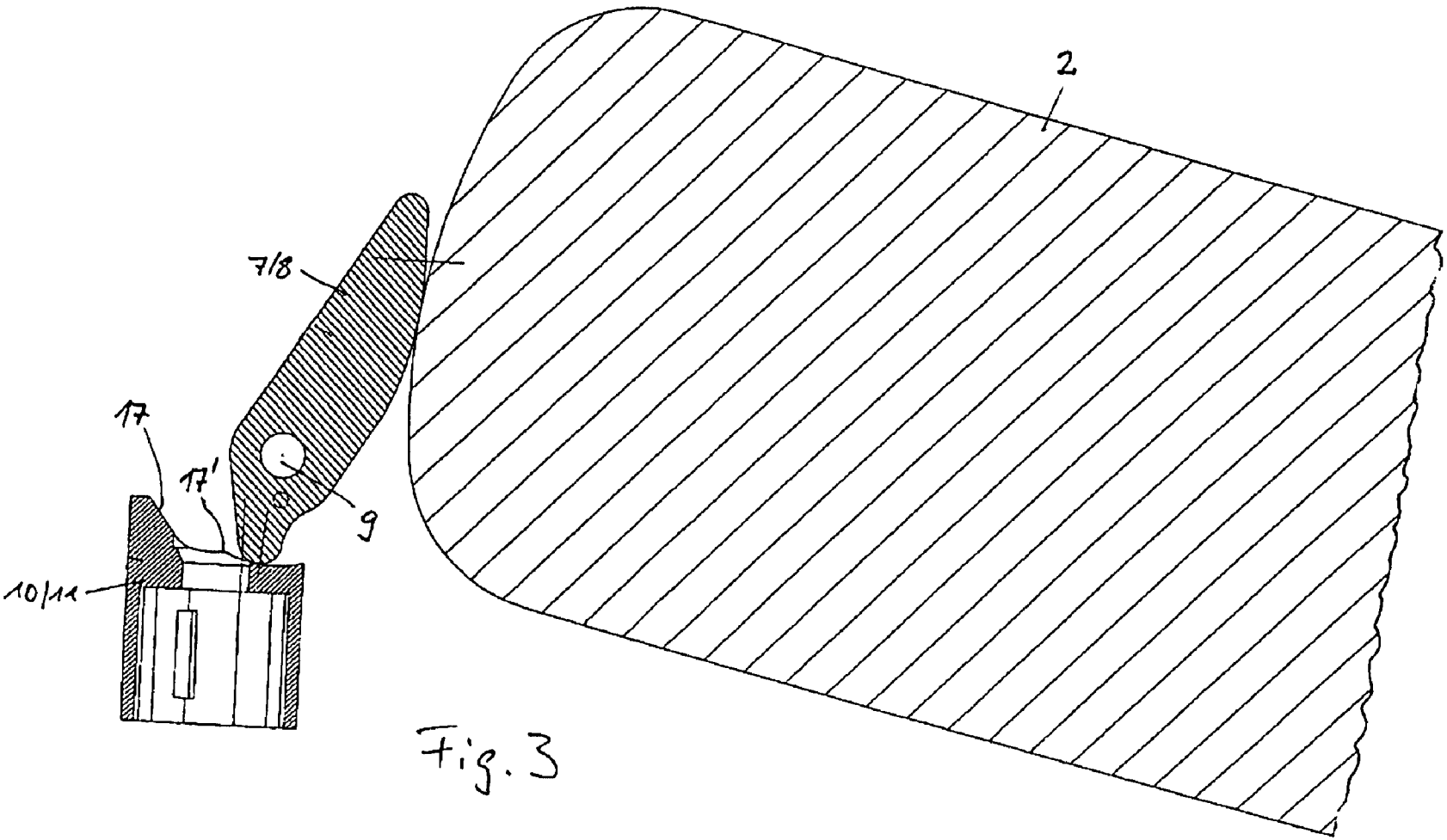
FIG. 3 shows a sectional illustration which corresponds to FIG. 2 and depicts the ski-boot sole being disengaged sideways.

When one of the sole holders 7 or 8 is pivoted into the position of FIG. 3 upon disengagement of the binding, and accompanying release of the ski-boot sole, in each case one of the pistons 10 or 11 is correspondingly pushed into the cylindrical housing 6, the air which is located in the housing 6 between the pistons 10 and 11 being compressed and some of this air being pushed out into the atmosphere via the windows 15 and 16. In this context, the windows 15 and 16 have a further function, i.e. they predetermine the throttle resistance which has to be overcome as the air is expelled into the atmosphere. The throttle cross section may possibly be limited by transparent "window panes" arranged in the windows 15 and 16, in which case the air displaced toward the atmosphere has to overcome a correspondingly increased throttle resistance. In relation to quick movements of the pistons 10 and 11, this throttle resistance has a damping action which, in the event of the ski boot suddenly being subjected to impact forces, counteracts premature disengagement of the ski boot from the binding. If, in contrast, the ski boot is rotated slowly about a vertical axis and/or is moved sideways relative to the ski 1, for example in the event of a fall from the standing position, the abovementioned damping of the piston movement is more or less absent because, in this case, the air contained in the housing 6 passes through the windows 15 and 16 at a low flow speed and can thus escape, as far as possible, in a resistance-free manner.

As can be seen from FIG. 3 in particular, that side of the head of the piston 10 or 11 which interacts with the piston-side arm of the sole holder 7 or 8, respectively, is designed as a guide 17. The shape of the guide determines the transmission ratio between the change in angle of rotation of the sole holder 7 or 8 and the adjustment of the associated piston 10 or 11. The guide 17 also has a protuberance-like elevation 17', in which case, in the event of the ski boot or the sole 2 being disengaged from the binding, the respective sole holder 7 or 8 remains in the position which has been reached in FIG. 3 and has to be pivoted back manually in the direction of the use position of FIG. 2. As soon as the piston-side lever arm of the sole holder 7 or 8 comes into contact with the associated piston 10 or 11 on the other side of the elevation 17', as seen in respect of the position in FIG. 3, the sole holder 7 or 8 is biased into the use position of FIG. 2 by the force of the helical compression spring 12, which is now able to push the piston 7 or 8 outward again within the housing 6.

The invention claimed is:

1. A boot-retaining unit of a binding for a ski for securing one end, the toe end, of a ski boot comprising two boot or sole holders (7, 8) which are pivotable about vertical axes (9) and are designed as double-armed lever arms, wherein the portions of the lever arms adjacent to the ski boot engage an end region of the sole or ski boot from the side, front and/or top and wherein the portions of the lever arms remote from the sole interact with pneumatic pistons (10, 11) which are displaceable in a direction transverse to the axis of the ski binding and are biased against said portions of the lever arms remote from the sole by means of a spring (12) which is common to both pistons and is clamped in between said pistons, wherein said vertical axes (9) of the boot holders (7, 8) are arranged at the open ends of a cylindrical housing (6) displaceably guiding the pistons (10, 11) and are substantially located within the piston cross section, as seen in an axial view of the pistons (10, 11).

2. The boot-retaining unit as claimed in claim 1, wherein the cylindrical housing (6) is arranged at the toe-side transverse periphery of a ski-boot-bearing plate (3) which is arranged on this transverse periphery such that it can be pivoted out relative to the ski (1) about a transverse axis (4).

3. The boot-retaining unit as claimed in one of the claim 1 or 2, further comprising a guideway (17) interacting with a portion of a lever arm of a respective sole holder (7, 8) which is remote from the sole and is disposed on a side of the piston which is directed toward the sole holders (7, 8).

4. The boot-retaining unit as claimed in claim 3, wherein the guideway (17) is subdivided into two portions by an elevation (17'), the associated sole holder (7, 8) being secured on the one portion in the disengaging position.

5. The boot-retaining unit as claimed in one of the claim 1 or 2, wherein an adjustable spring abutment (14) is arranged on the one piston (11), for the spring (12) which is clamped in between the pistons (10, 11).

6. The boot-retaining unit as claimed in claim 5, wherein the adjustable spring abutment provided is a nut (14) which is guided and secured within the piston (10) such that it can be displaced axially, but cannot be rotated, and can be adjusted by screwing action by means of an adjusting screw which is mounted axially on the head of the piston (11) by means of a circular disk (13') integrally formed on it.

7. The boot-retaining unit as claimed in one of the claim 1 or 2, wherein air contained in the cylindrical housing (6) between the pistons (10, 11) can be pushed out to the atmosphere, via a predetermined throttle path, upon inward displacement of one of the pistons (10, 11).

* * * * *